United States Patent [19]

Miyafuji et al.

[11] Patent Number: 4,732,732

[45] Date of Patent: Mar. 22, 1988

[54] MIGRATION RESISTANT PHOSPHOR BRONZE ALLOY

[75] Inventors: Motohisa Miyafuji; Yasuhiro Nakashima; Isao Hosokawa, all of Shimonoseki, Japan

[73] Assignee: Kabushiki Kaisha Kobe Seiko Sho, Kobe, Japan

[21] Appl. No.: 930,115

[22] Filed: Nov. 13, 1986

[30] Foreign Application Priority Data

Nov. 13, 1985 [JP] Japan ..... 60-254357

[51] Int. Cl.[4] ..... C22C 9/04

[52] U.S. Cl. ..... 420/476; 420/477; 420/499

[58] Field of Search ..... 420/472, 476, 477, 499; 148/412, 413, 433, 434

[56] References Cited

U.S. PATENT DOCUMENTS 2,460,991 2/1949 LeBrasse et al. ..... 420/472

FOREIGN PATENT DOCUMENTS 127840 6/1986 Japan ..... 420/472
127841 6/1986 Japan ..... 420/472
344018 7/1972 U.S.S.R. ..... 420/472

*Primary Examiner*—L. Dewayne Rutledge
*Assistant Examiner*—George Wyszomierski
*Attorney, Agent, or Firm*—Oblon, Fisher, Spivak, McClelland & Maier

[57] ABSTRACT

A phosphor bronze alloy excellent in migration resistance, which containing from 3.0 to 9.0% by weight of Sn, from 0.03 to 0.35% by weight of P, from 1.0 to 5.0% by weight of Zn, and the substantial balance of Cu and impurities. The phosphor bronze alloy according to this invention is excellent in the migration resistance as comparable with that of brass without degrading the solderability or electrical conductivity.

2 Claims, No Drawings

MIGRATION RESISTANT PHOSPHOR BRONZE ALLOY

BACKGROUND OF THE INVENTION

Field of the Invention

This invention concerns a phosphor bronze alloy excellent in migration resistance.

Description of the Prior Art

With the increasing demand for reducing the thickness and decreasing the size of electric and electronic components in recent years the number of electrodes has tended to be increased, for example, in integrated circuits and resistors. Along with the increase in the number of electrodes, pitches between electrodes are reduced from 1/10 inch to 1/20 inch and further to 1/30 inch due to the requirement of mounting them to printed circuit boards at a high density and in a reduced thickness and, correspondingly, the inter-electrode pitch of terminals and connectors are also decreased quite in the same manner. However, if the inter-electrode pitch in the electric or electronic components is reduced, water is deposited between the electrodes due to the condensation of moistures or intrusion of water. Copper ions are leached out at the portion deposited with water, the copper ions thus leached out are reduced by the electric potential between the electrodes and the thus reduced copper ions are deposited as metal copper. Such leaching, reduction and deposition occur repeatedly and, as a result, crystals of the deposited copper metal grow from the cathode and reach as far as the anode. Such a phenomenon is generally referred to as migration. If such migration occurs, short-circuit is resulted between the cathode and the anode.

The migration is liable to occur in phosphor bronze. Although it has been known that migration less occur in brass, brass has a defect of possibly suffering from stress corrosion crackings.

OBJECT OF THE INVENTION

Accordingly, it is an object of this invention to obtain a phosphor bronze alloy having migration-resistance comparable with that of brass with no degradation in the characteristics of phosphor bronze.

SUMMARY OF THE INVENTION

The foregoing object of this invention can be attained by a phosphor bronze alloy excellent in the migration resistance, which comprises from 3.0 to 9.0% by weight of Sn, from 1.0 to 5.0% by weight of Zn, from 0.03 to 0.35% by weight of P and the substantial balance of Cu and impurities.

DETAILED DESCRIPTION OF THE INVENTION

The phosphor bronze alloy according to this invention contains fundamental components as those in phosphor bronze specified in Japanese Industrial Standard : JIS H3110. The phosphor bronze is a ternary alloy containing from 3.0 to 9.0% by weight of Sn, from 0.03 to 0.35% by weight of P and the substantial balance of Cu.

The upper limit for the Sn content is defined in view of the productivity, while the lower limit thereof is defined in view of the tensile strength, elongation and the spring limit belonging to mechanical properties, as well as in view of the workability.

P behaves as an oxidizer for the complete deoxidization of the molten alloy thereby obtaining an intact cast ingot. If it is less than 0.03% by weight, the deoxidizing effect becomes insufficient, whereas if it is greater than 0.35% by weight, it reduces the electrical conductivity and further degrades the solderability.

The feature of this invention resides in improving the migration resistance to a level comparable with that of brass without degrading the advantageous properties inherent to phosphor bronze by adding Zn to the phosphor bronze to prepare a quarternary alloy.

Zn is an essential element for suppressing the Cu migration thereby reducing leak current in case water should intrude into electrodes made of the phosphor bronze put under the application of electric voltage. If Zn is less than 1.0% by weight, such effect is insufficient, whereas if it exceeds 5.0% by weight, advantageous feature of the phosphor bronze is lost such as by the reduction in the electrical conductivity or liability of stress corrosion cracks although the migration resistance is improved. Accordingly, the Zn content is defined as from 1.5 to 5.0% by weight.

EXAMPLE

Explanation will then be made to the phosphor bronze alloy according to this invention for the excellent migration resistance thereof while referring to examples.

Copper alloys having chemical components as shown in Table 1 were cast into 18 mm thickness through a horizontal continuous casting system and both of the surfaces of the thus obtained casting ingots were scalped into 15 mm thickness. After the scalping, homogenizing treatment was applied at 680° C. for 8 hours and, then, cold rolling and intermediate annealing at 500° C. for 2 hours were applied repeatedly to obtain strips of 0.25 mm thickness.

The following tests were conducted by using the strips.

In Table 1, No. 1–No. 8 represent alloys of the examples according to this invention, while No. 9–No. 12 represent alloys of comparative examples.

TABLE 1

| | Chemical components (wt %) | | | | |
|---|---|---|---|---|---|
| | Sn | P | Zn | Cu | Remarks |
| Example | | | | | |
| 1 | 3.8 | 0.03 | 1.5 | balance | phosphor bronze |
| 2 | 4.0 | 0.04 | 2.1 | balance | of the invention |
| 3 | 4.1 | 0.05 | 3.5 | balance | |
| 4 | 6.1 | 0.04 | 2.3 | balance | |
| 5 | 5.9 | 0.04 | 3.8 | balance | |
| 6 | 8.0 | 0.20 | 2.2 | balance | |
| 7 | 8.1 | 0.18 | 3.9 | balance | |
| 8 | 8.3 | 0.20 | 4.5 | balance | |
| Comparative Example | | | | | |
| 9 | 4.1 | 0.06 | 5.7 | balance | phosphor bronze with higher Zn content |
| 10 | 6.0 | 0.04 | 0.0 | balance | conventional phosphor bronze |
| 11 | 7.9 | 0.20 | 0.8 | balance | phosphor bronze with lower Zn content |
| 12 | — | — | balance | 69 | conventional 7/3 brass |

Migration Resistance Test

The migration resistance was tested by the maximum leak current value when DC voltage at 14 V is applied as the judging criterion. An ABS resin layer of 1 mm thickness formed with a discharge hole of 10 mm diameter was put between two sheets of the test specimens. Retainer plates were disposed on both ends of the two test pieces, which were urged to fix from above by clips. Then, conductive wires were connected to the respective ends of the two test pieces and the wires are connected to anode and cathode terminals of a battery so as to serve one of the test pieces as an anode and the other of them as a cathode.

To the specimens put under the above-mentioned state, drying/wetting test of immersing the specimen in tap water for 5 minutes and then drying for 10 minutes, while applying DC voltage at 14 V, was applied to measure the maximum leak current value up to 50 cycles by way of a high sensitive recorder. The results are shown in Table 2.

TABLE 2

| | Electrical conductivity (% IACS) | Maximum leak current (A) | Solderability | Remark |
|---|---|---|---|---|
| Example | | | | |
| 1 | 20 | 0.57 | pass | Phosphor bronze of the invention |
| 2 | 21 | 0.53 | pass | |
| 3 | 20 | 0.54 | pass | |
| 4 | 15 | 0.52 | pass | |
| 5 | 14 | 0.55 | pass | |
| 6 | 12 | 0.55 | pass | |
| 7 | 11 | 0.50 | pass | |
| 8 | 10 | 0.48 | pass | |
| Comparative Example | | | | |
| 9 | 17 | 0.52 | slightly failed | Phosphor bronze with higher Zn content |
| 10 | 15 | 4.53 | pass | conventional phosphor bronze |
| 11 | 12 | 0.83 | pass | phosphor bronze with lower Zn content |
| 12 | 28 | 0.55 | failed | conventional 7/3 brass |

As can be seen from Table 2, the alloys of the examples according to this invention (No. 1–No. 8) show leak current which is as low as from 0.48 to 0.57 A as compared with comparative alloys No. 10 and No. 11 of lower Zn content, and which is comparable with that in brass (comparative alloy No. 12) and are excellent in the migration resistance.

Although the DC voltage at 14V was applied for the measurement of the leak current in this embodiment, the terminal connector made of the phosphor bronze alloy according to this invention can also be used in a general AC circuit working at 100–120 V. While the conventional phosphor bronze tends to cause migration and electric discharge in the state where moisture is condensated, the alloy according to this invention is suitable not only for use in automobiles but also in home uses or industrial applications.

Electrical Conductivity Test

Electrical conductivity was measured for the alloys of the examples according to this invention and comparative alloys according to JIS0505 and the results are shown in Table 2.

As shown in Table 2, the alloys of the examples according to this invention show electrical conductivity comparable with that in brass (comprative example alloy No. 12).

Solderability

Test specimens 0.25 mm thickness, 25 mm width and 50 mm length were prepared from the alloys having compositions shown in Table 2, immersed in eutectic solder: 60Sn–40Pb at 230° C. and the solderability was examined with weakly active MIL-F-14256RMA type flux according to MIL-STD-202E 208C.

It can be seen that the alloys of the examples according to this invention are superior in the solderability as compared with comparative alloy No. 9 which contains the same extent of Sn and P and is different in the Zn content.

As has been described above according to this invention, the phosphor bronze alloy having the migration resistance comparable with that of brass can be obtained without degrading the advantageous characteristics of the phosphor bronze such as excellent electrical conductivity and solderability.

What is claimed is:

1. A phosphor bronze alloy excellent in migration resistance, which consists essentially of from 3.0 to 9.0% by weight of Sn, from 0.03 to 0.35% by weight of P, from 1.0 to 5.0% by weight of Zn, and the substantial balance of Cu and impurities.

2. A phosphor bronze excellent in migration resistance as defined in claim 1, which consists essentially of from 4.0 to 8.1% by weight of Sn, from 2.0 to 3.9% by weight of Zn, from 0.04 to 0.20% by weight of P and the substantial balance of Cu and impurities.

* * * * *